US009259739B2

(12) United States Patent
Aizawa et al.

(10) Patent No.: US 9,259,739 B2
(45) Date of Patent: Feb. 16, 2016

(54) VERTICAL-TYPE MILL

(71) Applicant: Mitsubishi Hitachi Power Systems, Ltd., Yokohama-shi, Kanagawa (JP)

(72) Inventors: Takashi Aizawa, Kure (JP); Takehiro Aoyama, Kure (JP); Fumiya Hamanaka, Kure (JP)

(73) Assignee: Mitsubishi Hitachi Power Systems, Ltd., Yokohama-shi (JP)

( * ) Notice: Subject to any disclaimer, the term of this patent is extended or adjusted under 35 U.S.C. 154(b) by 0 days.

(21) Appl. No.: 14/386,670

(22) PCT Filed: Mar. 21, 2013

(86) PCT No.: PCT/JP2013/058091

§ 371 (c)(1),
(2) Date: Sep. 19, 2014

(87) PCT Pub. No.: WO2013/141303

PCT Pub. Date: Sep. 26, 2013

(65) Prior Publication Data

US 2015/0076263 A1 Mar. 19, 2015

(30) Foreign Application Priority Data

Mar. 21, 2012 (JP) ..... 2012-063744

(51) Int. Cl.
*B02C 15/00* (2006.01)
*B02C 23/12* (2006.01)

(52) U.S. Cl.
CPC ..... *B02C 15/001* (2013.01); *B02C 15/007* (2013.01); *B02C 23/12* (2013.01); *B02C 15/00* (2013.01); *B02C 2015/002* (2013.01)

(58) Field of Classification Search
CPC ..... B02C 15/00; B02C 15/002; B02C 15/001
USPC ..... 241/117, 119
See application file for complete search history.

(56) References Cited

U.S. PATENT DOCUMENTS 5,251,831 A * 10/1993 Yoshida ..... B02C 23/32 209/139.1
5,386,619 A * 2/1995 Wark ..... B02C 15/007 241/109

(Continued)

FOREIGN PATENT DOCUMENTS

JP 58-180242 A 10/1983
JP 62-204861 A 9/1987

(Continued)

OTHER PUBLICATIONS

International Search Report dated Jun. 25, 2013 with English translation (three (3) pages).

*Primary Examiner* — Faye Francis
(74) *Attorney, Agent, or Firm* — Crowell & Moring LLP

(57) ABSTRACT

Provided is a vertical-type mill whereby abrasion of a hopper and accumulation of coarse particles in the hopper can both be prevented. A vertical-type mill provided with a milling mechanism for milling a material to be milled and obtaining solid particles by meshing of a milling roller or milling ball and a milling table, a classification mechanism having a classifier for classifying milled solid particles and a hopper (11) for collecting coarse particles that are classified by the classifier and dropped downward and leading the coarse particles toward the milling mechanism, a raw material feeding pipe (1) for charging the material to be milled into the milling table, and housings (43*a, b*), wherein the raw material feeding pipe is provided in the hopper so that the relationship $0.15 \leq L'/L \leq 0.5$ is satisfied, where, using the boundary line between a cylindrical part of the hopper and an inverted conical part of the hopper as a reference position, L is the distance from the reference position to the top end of the hopper, and L' is the distance from the reference position to the bottom end (1*a*) of the raw material feeding pipe.

6 Claims, 9 Drawing Sheets

(56) References Cited

U.S. PATENT DOCUMENTS 5,622,321 A * 4/1997 Brundiek ..... B02C 23/16 209/139.2
5,667,149 A * 9/1997 Eisinger ..... B02C 15/001 241/119
5,944,270 A * 8/1999 Farris ..... B02C 15/00 241/119
5,957,300 A * 9/1999 Nardi ..... B02C 15/001 209/139.2
6,607,079 B2 * 8/2003 Laux ..... B02C 23/32 209/139.1
7,156,235 B2 * 1/2007 Eisinger ..... B02C 23/32 209/138
8,899,163 B2 * 12/2014 Takeuchi ..... B02C 15/007 110/222
2003/0034278 A1 * 2/2003 Laux ..... B02C 23/32 209/143
2004/0084556 A1 * 5/2004 Chen ..... B02C 15/045 241/79.1
2005/0242215 A1 * 11/2005 Eisinger ..... B02C 23/32 241/20
2007/0228194 A1 * 10/2007 Takeno ..... B07B 7/01 241/24.24
2011/0108643 A1 * 5/2011 Krause ..... B02C 15/04 241/18
2012/0085849 A1 * 4/2012 Knope ..... B02C 15/001 241/101.2
2013/0055934 A1 * 3/2013 Takeuchi ..... B02C 15/007 110/222
2013/0327861 A1 * 12/2013 Matsumoto ..... B07B 7/02 241/79

FOREIGN PATENT DOCUMENTS

JP 2007-61684 A 3/2007
JP 2007-117903 A 5/2007

* cited by examiner (a)

(b)

(c)

VERTICAL-TYPE MILL

TECHNICAL FIELD

The present invention relates to a vertical-type mill capable of milling a solid raw material by means of a milling roller or a milling ball and a milling table and adjusting the size of particles to a predetermined one by means of a classification device.

BACKGROUND ART

Generally, a vertical-type mill has a drive portion which drives a milling table to rotate, a milling portion which mills a raw material (for example, coal) and obtains solid particles by meshing of the milling table with a milling roller or a milling ball, a classification portion which is placed above the milling portion and which has a classifier for classifying the milled solid particles and a recovery cone (hopper) for collecting coarse particles classified and dropped downward and guiding the coarse particles to the milling portion, a distribution portion which distributes fine particles sent from the classification portion to a supply destination (for example, a boiler), and a coal feeding pipe (raw material feeding pipe) through which the raw material can be inputted from above the milling table (see Patent Literature 1).

The raw material supplied from the coal feeding pipe falls down to the central portion of the milling table. Since the milling table is rotating, the raw material falling down onto the milling table moves on the milling table toward the outer peripheral portion thereof while drawing a spiral locus due to centrifugal force caused by the rotation. Then, the raw material is bitten and milled between the milling table and the milling roller or the milling ball. Milled solid particles are blown upward while dried by hot air introduced from a throat provided around the milling table. The solid particles blown upward are classified by the classifier. Coarse particles larger than a predetermined particle size fall down into the recovery cone and are inputted onto the milling table again. On the other hand, fine particles not larger than the predetermined particle size are passed through the classifier and then conveyed to a predetermined supply destination by the distribution portion.

Here, the structure of a hopper will be described in detail. A background-art hopper is a funnel-like structure in which the diameter of a top end opening portion is larger than the diameter of a bottom end opening portion as shown in Patent Literature 1. In other words, the hopper is formed out of a hollow inverted conical part and a cylindrical part extending downward from the bottom end opening portion of the inverted conical part. The hopper must have a function of allowing coarse particles classified by the classifier to fall down toward the milling table through the bottom end opening portion as described above. To this end, it is necessary to set the inclination angle of the inverted conical part at an angle which is sharp enough to prevent the coarse particles from being deposited in the hopper. That is, if the inclination angle of the inverted conical part is gentle, the coarse particles returned to the hopper by the classifier will be deposited in the hopper. It is therefore necessary to form the inverted conical part into a shape with an angle sharp enough to allow the coarse particles to fall down into the hopper.

Whether the coarse particles are deposited or not depends on the repose angle (which is an angle of a slope with which powder piled up can be kept stable without collapsing spontaneously) of the coarse particles. For example, it has been known that the repose angle of pulverized coal is about 30 degrees to 40 degrees. Therefore, the inclination angle (which is an angle from a horizontal plane) of the inverted conical part of the hopper is set at about 50 degrees in the vertical-type mill for milling coal, as shown in Patent Literature 1. Incidentally, also in the invention, the inclination angle θ of the hopper is the same as in the background art to be about 50 degrees (see FIG. 2).

CITATION LIST

Patent Literature

Patent Literature 1: JP-A-2007-61684

SUMMARY OF INVENTION

Technical Problem

However, the hopper may have the following problems due to the relationship between the bottom end position of the raw material feeding pipe and the position of the boundary line between the inverted conical part and the cylindrical part (hereinafter referred to as "reference position": see FIG. 5). That is, when the bottom end position of the raw material feeding pipe is away from the reference position, the raw material inputted through the raw material feeding pipe collides with the hopper while diffusing horizontally. Therefore, the first problem is that the hopper may be abraded. In order to solve the first problem, the bottom end position of the raw material feeding pipe may be made close to the reference position. However, this narrows the gap between the raw material feeding pipe and the hopper. Therefore, the gap may be clogged with coarse particles. As a result, there arises a second problem that many coarse particles may be deposited on the hopper. On the other hand, in order to solve the second problem, the raw material feeding pipe may be kept away from the hopper. Then, the first problem may arise this time.

It is also necessary to perform routine maintenance on the vertical-type mill. It is a permanent problem to improve the maintainability.

The present invention has been developed to solve the foregoing problems. A first object of the invention is to provide a vertical-type mill capable of preventing a hopper from being abraded and preventing coarse particles from being deposited in the hopper. In addition, a second object of the invention is to improve the maintainability.

Solution to Problem

In order to attain the foregoing objects, according to a first means of the present invention, there is provided a vertical-type mill including: a milling mechanism which has a milling roller or a milling ball, and a milling table rotatably disposed in a position facing the milling roller or the milling ball, and which mills a material to be milled and obtains solid particles by meshing of the milling table with the milling roller or the milling ball; a classification mechanism which is disposed above the milling mechanism and which has a classifier for classifying the milled solid particles, and a hopper for collecting coarse particles classified by the classifier and dropped downward, and guiding the coarse particles to the milling mechanism; a raw material feeding pipe through which the material to be milled can be inputted onto the milling table and which is provided so that a bottom end of the raw material feeding pipe can be located inside the hopper; and a housing which receives the milling mechanism and the classification mechanism; wherein: the hopper is a funnel-like structure having a hollow inverted conical part whose diameter is reduced as it goes from a top end thereof toward a bottom end thereof, and a cylindrical part which extends downward from the bottom end of the inverted conical part; and the raw material feeding pipe is provided in the hopper to satisfy the relation $0.15 \leq L'/L \leq 0.5$, where, using a boundary line between the inverted conical part and the cylindrical part of the hopper as a reference position, L is a distance from the reference position to the top end of the hopper, and L' is a distance from the reference position to the bottom end of the raw material feeding pipe.

According to the first means, the raw material feeding pipe is provided in the hopper to satisfy the relation $0.15 \leq L'/L \leq 0.5$. It is therefore possible to prevent the hopper from being abraded and prevent the coarse particles from being deposited in the hopper.

According to a second means of the invention, there is provided the first means, wherein: the relation $L'/L \leq 0.35$ is further satisfied. According to the second means, it is possible to more surely prevent the hopper from be abraded.

According to a third means of the invention, there is provided the first or second means, wherein: the housing is formed so that the housing can be divided into an upper housing receiving the classification mechanism and a lower housing receiving the milling mechanism; the hopper is formed so that the hopper can be divided into an upper hopper and a lower hopper; the bottom end of the raw material feeding pipe is in a position as high as or higher than a boundary line between the upper hopper and the lower hopper; and a boundary line between the upper housing and the lower housing is in a position as high as or lower than the boundary line between the upper hopper and the lower hopper.

According to the third means, the raw material feeding pipe and the upper hopper are received (retracted) in the upper housing, so that the upper housing can be slid horizontally with respect to the lower housing and removed therefrom. An operation of lifting up the upper housing is therefore not necessary. In addition, for maintenance, the upper housing can be removed and put in a workplace as it is. In this manner, the maintainability can be improved according to the third means.

According to a fourth means of the invention, there is provided the third means, wherein: the boundary line between the upper hopper and the lower hopper is in a position higher than the reference position. Also according to the fourth means, the maintainability is improved.

According to a fifth means of the invention, there is provided the third means, wherein: the boundary line between the upper housing and the lower housing is in a position higher than the reference position. Also according to the fifth means, the maintainability is improved.

According to a sixth means of the invention, there is provided the third means, further including a pressure mechanism which has: a pressure device; a pressure frame which transmits pressure to be applied to the milling table to the milling roller or the milling ball; and a pressure rod which couples the pressure device with the pressure frame; wherein: a rod box through which the pressure rod can be inserted is provided in an outer peripheral surface of the lower housing; and a cover member which closes an opening formed in a top portion of the rod box is provided in a bottom end portion of the upper housing.

According to the sixth means, the opening in the top portion of the rod box can be closed by the cover member only if the upper housing and the lower housing are placed on top of each other. Thus, an operation of assembling the housing can be made easy. In addition, even if the upper housing might lose its balance to overturn when the upper housing is removed and put in a workplace for maintenance, the cover member can prevent the overturn. Thus, the maintainability can be improved more greatly.

Advantageous Effects of Invention

According to the present invention, the aforementioned configuration is provided. Accordingly, it is possible to prevent the hopper from being abraded and prevent the coarse particles from being deposited in the hopper. In addition, according to the invention, it is possible to improve the maintainability.

DESCRIPTION OF EMBODIMENT

Figure 1:
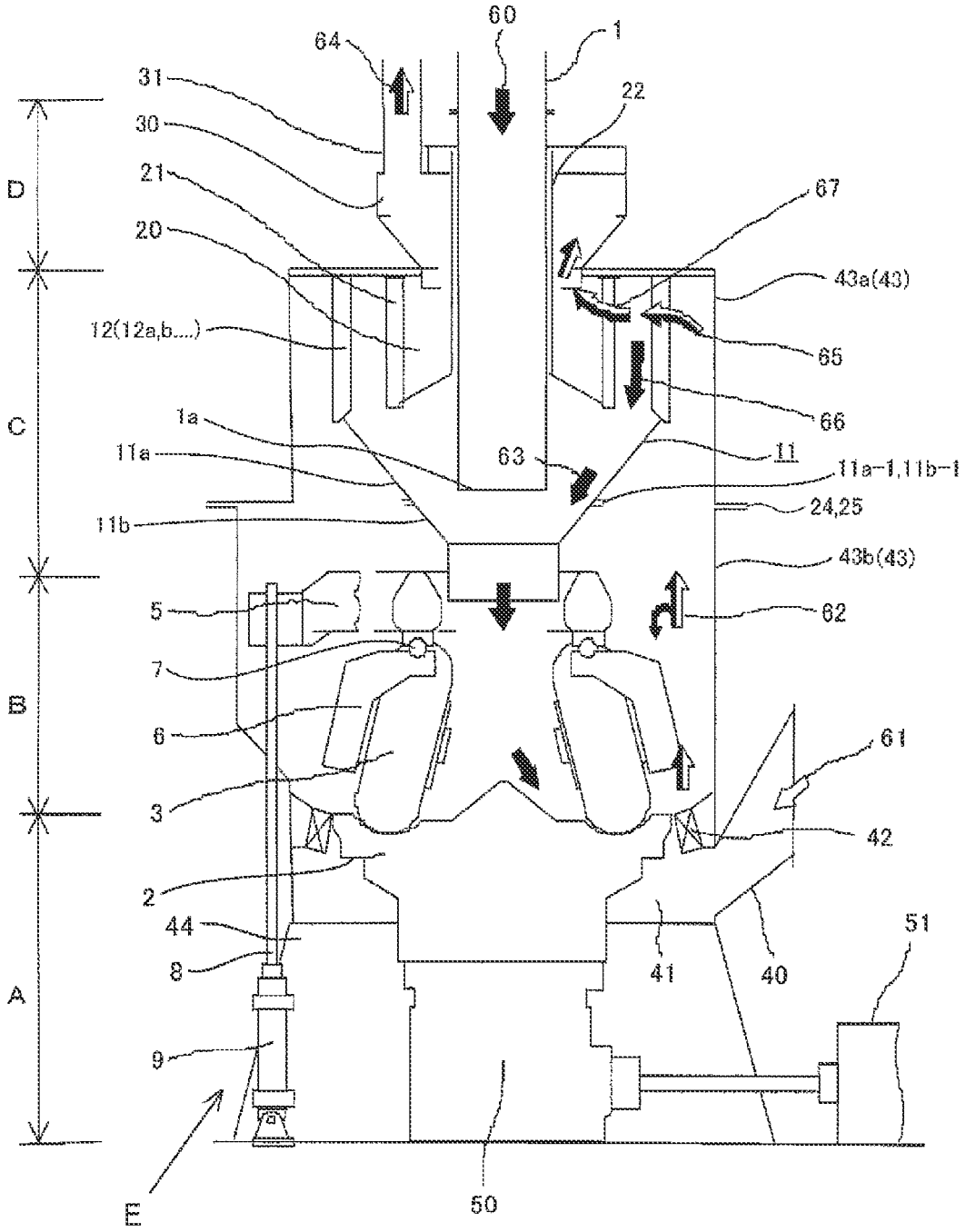
FIG. 1 A view showing the configuration of a vertical-type mill according to an embodiment of the present invention.

An embodiment of the present invention will be described below with reference to the drawings. As shown in FIG. 1, a vertical-type mill according to the embodiment of the invention is provided with a drive portion A which drives a milling table 2 to rotate, a milling portion (milling mechanism) B which mills coal as a material to be milled and obtains solid particles, a classification portion (classification mechanism) C which classifies the solid particles obtained by the milling portion B, a distribution portion D which conveys the solid particles classified by the classification portion C to a predetermined supply destination, and a pressure portion (pressure mechanism) E which transmits a milling load to a milling roller 3. Incidentally, the milling portion B and the classification portion C are received in cylindrical housings 43*a* and 43*b*.

As illustrated by the arrows in FIG. 1, coal (material to be milled) 60 supplied from a coal feeding pipe (raw material feeding pipe) 1 falls down to the central portion of the milling table 2 which is rotating, and then moves on the milling table 2 toward the outer peripheral portion thereof while drawing a spiral locus due to centrifugal force caused by the rotation. The coal is bitten and milled between the milling table 2 and the milling roller 3 which has a tire-like shape.

The milled coal is blown upward while dried by hot air 61 introduced through a throat 42. Of powder 62 blown upward, large-size particles fall down due to gravity on the way of being conveyed to the classification portion C, and are returned to the milling portion B (primary classification). A group of particles arriving at the classification portion C are classified into fine particles and coarse particles (secondary classification). The coarse particles collected by a hopper 11 fall down to the milling portion B and are milled again. On the other hand, the fine particles passing through the classification portion C are distributed to a plurality of coal delivery pipes 31 in a distributor 30, and delivered as product fine powder 64 to a boiler (not shown). Incidentally, in the following description, the coarse particles classified by the classification portion C and falling down into the hopper 11 may be referred to as "return coal".

In the milling portion B, the milling roller 3 is supported by a pressure frame 5 through a roller bracket 6 and a roller pivot 7. When the pressure frame 5 is pulled downward by a pressure device 9 through pressure rods 8, a milling load can be transmitted to the milling roller 3. Incidentally, the pressure portion E is constituted by the pressure device 9, the pressure frame 5 and the pressure rods 8.

The classification portion C includes two classifiers 12 and 20 and the hopper 11. The classifier 12 has a fixed type classification mechanism, and the classifier 20 has a rotary type classification mechanism. Specifically, the classifier 12 includes a plurality of fixed fins 12*a*, 12*b* . . . suspended downward from the ceiling surface of the classification portion C. The fixed fins 12*a*, 12*b* . . . are fixed at desired angles with respect to the direction of the central axis of the classification portion C. On the other hand, the classifier 20 includes a rotary shaft 22, rotary fins 21 which are supported on the rotary shaft 22, and a motor (not shown) which drives the rotary shaft 22 to rotate. Each rotary fin 21 has a plate whose longitudinal direction extends substantially in parallel to the direction of the central axis of the classification portion C. A large number of the rotary fins 21 are disposed at desired angles with respect to the central axis of the classification portion C so that the rotary fins 21 can rotate around the central axis of the classification portion C. The particle size distribution of the product fine powder 64 is adjusted by the rotation speed of the rotary fins 21.

Figure 2:
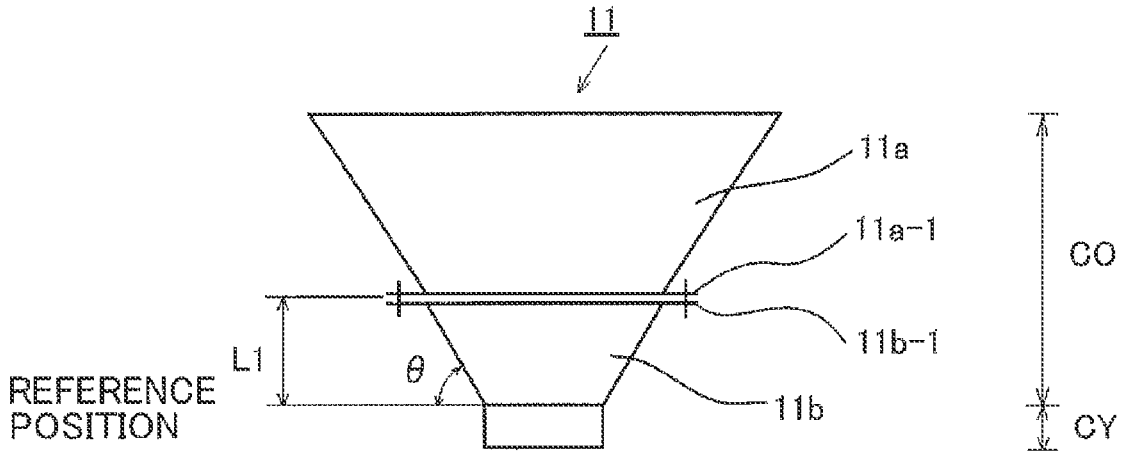
FIG. 2 A view showing the structure of a hopper shown in FIG. 1.

The hopper 11 is disposed under the two classifiers 12 and 20 and above the milling table 2. As shown in FIG. 2, the hopper 11 is a funnel-like structure which has a hollow inverted conical part CO whose diameter is reduced as it goes from a top end thereof toward a bottom end thereof, and a cylindrical part CY which extends downward from the bottom end of the inverted conical part. Incidentally, the inclination angle θ of the inverted conical part CO of the hopper 11 is 50 degrees.

Further, the hopper 11 is divided into two at a position of height L1 from a reference position when the boundary line between the inverted conical part CO and the cylindrical part CY is set as the reference position. That is, the hopper 11 includes two parts, that is, an upper hopper 11*a* and a lower hopper 11*b*. A flange portion 11*a*-1 provided at the bottom end of the upper hopper 11*a* and a flange portion 11*b*-1 provided at the top end of the lower hopper 11*b* are placed on top of each other, and the two flange portions are fixed by bolts and nuts. Thus, the upper hopper 11*a* and the lower hopper 11*b* can be integrated. Incidentally, it is a matter of course that the portion where the upper hopper 11*a* and the lower hopper 11*b* are connected to each other is formed into a smooth surface to prevent coarse particles from being deposited thereon.

Figure 3:
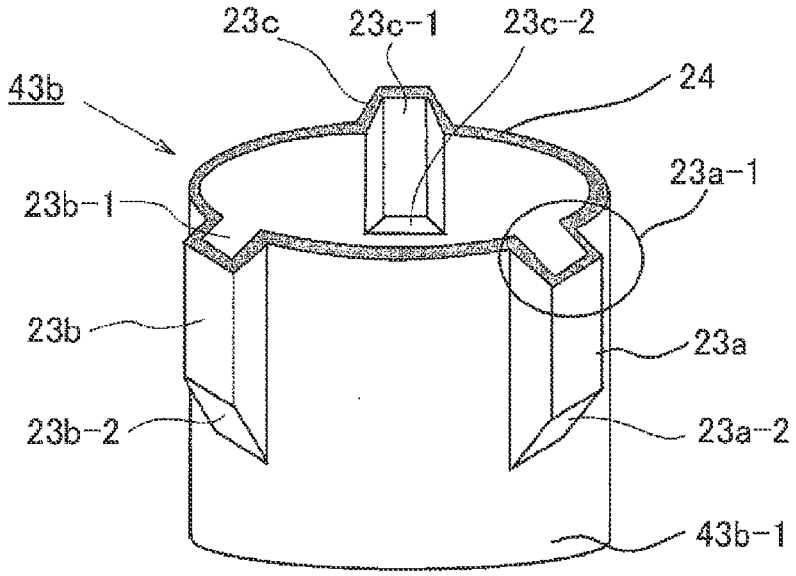
FIG. 3 A view showing the structure of a lower housing shown in FIG. 1.

A housing 43 has a configuration in which the housing 43 can be divided into two, that is, the upper housing 43*a* receiving the classification portion C and the lower housing 43*b* receiving the milling portion B. As shown in FIG. 3, the lower housing 43*b* has a cylindrical chassis 43*b*-1, and three rod boxes 23*a*, 23*b* and 23*c* provided in the outer peripheral surface of the chassis 43*b*-1 so as to extend circumferentially at equally spaced intervals (pitches of 120°). The pressure rods 8 are inserted into the rod boxes 23*a* to 23*c* respectively. The rod box 23*a* is a rectangular cylinder having a top opening 23*a*-1 and a bottom opening 23*a*-2. The rod box 23*a* is attached to the outer peripheral surface of the lower housing 43*b* so that the longitudinal direction of the rod box 23*a* can extend in parallel with the central axis of the lower housing 43*b*. Incidentally, the other rod boxes 23*b* and 23*c* also have the same configuration.

Figure 4:
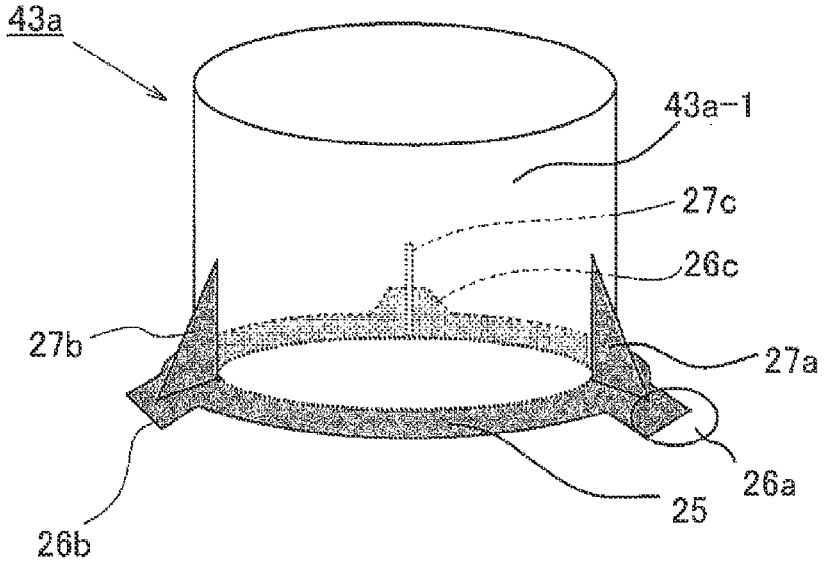
FIG. 4 A view showing the structure of an upper housing shown in FIG. 1.

On the other hand, as shown in FIG. 4, the upper housing 43*a* has a cylindrical chassis 43*a*-1 and a flange portion 25 provided at the bottom end of the chassis 43*a*-1. Three upper covers 26*a*, 26*b* and 26*c* are provided in the flange portion 25 so as to be arranged circumferentially at equally spaced intervals (pitches of 120°) and to extend outward from the center of the flange portion 25. The upper cover 26*a* has a size large enough to cover the whole of the top opening 23*a*-1 of the rod box 23*a*, and so are the other upper covers 26*b* and 26*c*. Incidentally, reinforcing ribs 27*a*, 27*b* and 27*c* are provided in the three upper covers 24*a* to 24*c* respectively.

Due to the configuration made thus, the openings 23*a*-1, 23*b*-1 and 23*c*-1 of the rod boxes 23*a* to 23*c* in the lower housing 43*b* can be covered with the upper covers 26*a*, 26*b* and 26*c* respectively when the upper housing 43*a* is put on top of the lower housing 43*b* so that the flange portion 25 of the upper housing 43*a* and a top end edge 24 of the lower housing can be placed on top of each other.

Figure 5:
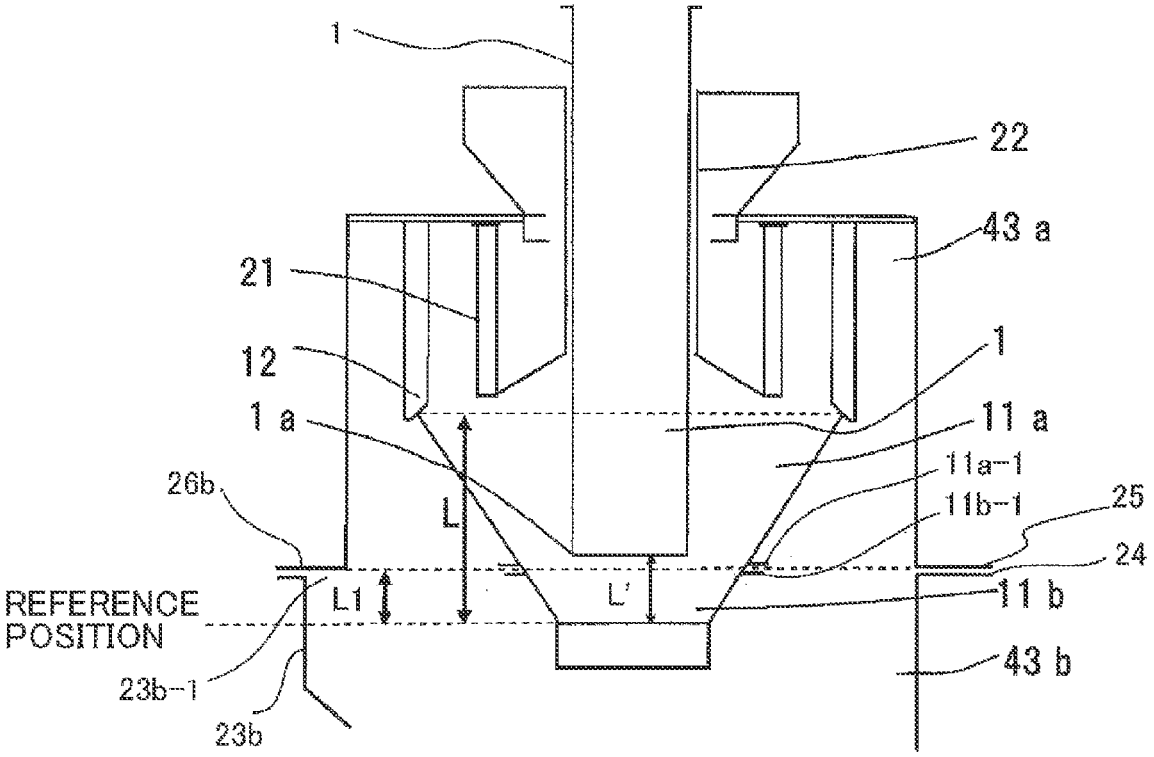
FIG. 5 A view showing the relationship among a division position of the hopper, a division position of a housing and a position of a bottom end of a coal feeding pipe, relative to a reference position.

Next, an attachment position of a bottom end 1*a* of the coal feeding pipe 1 will be described. The attachment position is very important to prevent the abrasion of the hopper 11 and elongate the life thereof and to prevent the coarse particles from being deposited in the hopper 11. To this end, as shown in FIG. 5, the present inventors input coal 60 through the coal feeding pipe 1 while changing a distance L' between the reference position of the hopper 11 and the bottom end 1*a* of the coal feeding pipe 1 within a range of from 0 to L, and experimentally obtained an abrasion ratio of the hopper 11 and a deposition ratio of the coarse particles on that occasion in order to look for a suitable position of the bottom end 1*a* of the coal feeding pipe 1. The hopper 11 and the coal feeding pipe 1 used in the experiment are the same as those in the background art. That is, the hopper 11 has dimensions and a shape as that in the background art. The coal feeding pipe 1 is used in combination with the hopper 11 as in the background art, and has a specific opening diameter. Incidentally, L designates a distance between the reference position and the top end of the hopper 11.

Figure 6:
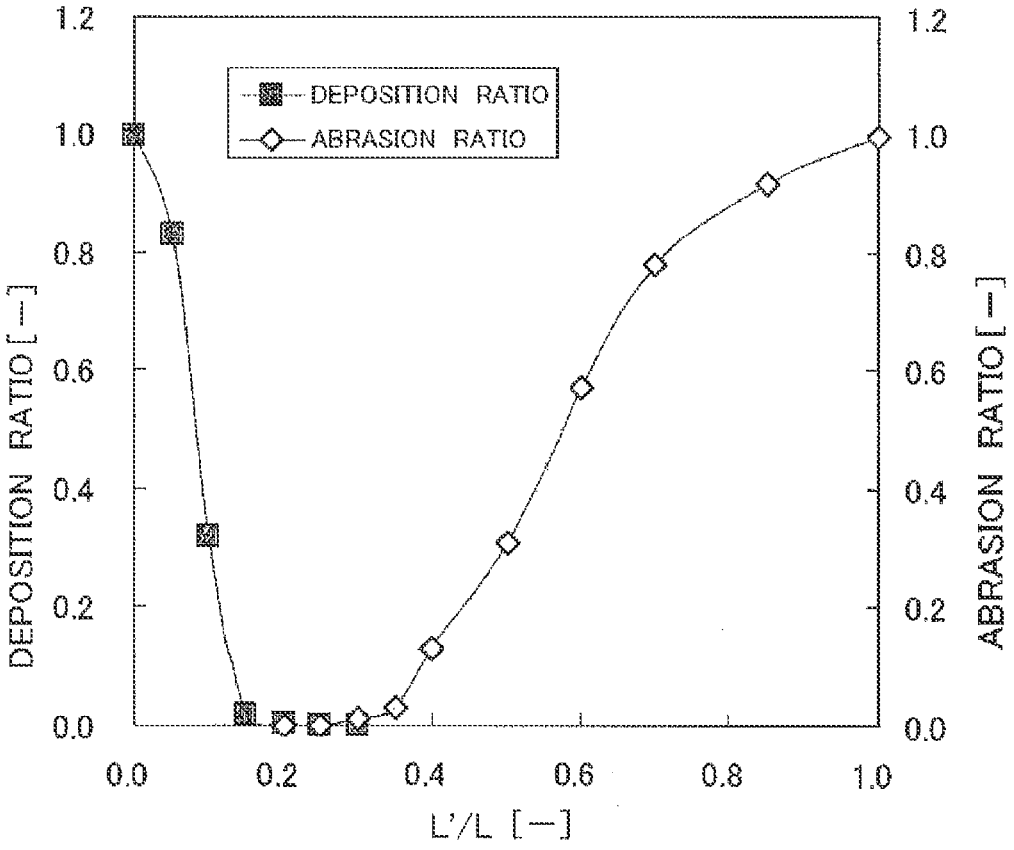
FIG. 6 A graph showing characteristics about a deposition ratio and an abrasion ratio with respect to the position of the bottom end of the coal feeding pipe.

The result is shown in FIG. 6. Here, the "deposition ratio" in the left vertical axis expresses values of deposition amounts for L'=0 to L'=L relative to the deposition amount set as 1 for the case of L'=0, and the "abrasion ratio" in the right vertical axis expresses values of abrasion amounts for L'=0 to L'=L relative to the abrasion amount set as 1 for the case of L'=L. Incidentally, L'/L=0 means that the bottom end 1*a* of the coal feeding pipe 1 is located in the reference position, and L'/L=1 means that the bottom end 1*a* of the coal feeding pipe 1 is located in the top end of the hopper 11.

As for the deposition ratio, as apparent from FIG. 6, the value of the deposition ratio is smaller as L'/L is larger in a direction away from 0, and the deposition ratio becomes substantially zero when L'/L is not smaller than 0.15. That is, it can be known that, when L'/L is not smaller than 0.15, return coal is hardly deposited in the hopper 11. Thus, adhesion of the return coal can be prevented and clogging caused by the adhesion of the return coal can be prevented. It is therefore desirable that L'/L is not smaller than 0.15 from the point of view of preventing the return coal from being deposited in the hopper 11.

On the other hand, the abrasion ratio is substantially zero when L'/L is in a range of from 0 to 0.35, but the abrasion ratio begins to increase when L'/L exceeds 0.35. It is therefore desirable that L'/L is not larger than 0.35 from the point of view of preventing the abrasion of the hopper 11. In the vertical-type mill, however, routine inspection is usually performed once per year. Therefore, even if the hopper 11 is abraded, the hopper 11 can be repaired at the time of the routine inspection. In this case, the abrasion of the hopper 11 can be sufficiently allowed as long as the extent of the abrasion is low enough to continue the use of the hopper 11 until the routine inspection. The allowable range of the abrasion ratio is up to about 0.3. Accordingly, when abrasion is allowed to some extent in consideration of routine inspection, the abrasion ratio may be set to be not larger than 0.5.

Thus, from the result of the experiment, it can be known that the attachment position of the bottom end 1*a* of the coal feeding pipe 1 is preferably set within a range satisfying "0.15≤L'/L≤0.5". Particularly in order to make the abrasion substantially zero, it is known that the bottom end 1*a* of the coal feeding pipe 1 is desirably disposed within a range satisfying "0.15≤L'/L≤0.35".

In addition, in the embodiment, the position of the bottom end 1*a* of the coal feeding pipe 1, the division position of the hopper 11 and the division position of the housing 43 relative to the reference position are set as follows in order to improve working efficiency or the like during maintenance. That is, as shown in FIG. 5, the boundary line between the upper housing 43*a* and the lower housing 43*b* is in a position higher than the reference position by a distance L1. In addition, the boundary line between the upper hopper 11*a* and the lower hopper 11*b* is also in a position higher than the reference position by the distance L1 in the same manner. That is, the division position of the housing 43 and the division position of the hopper 11 are in the same position relative to the reference position. On the other hand, the bottom end 1*a* of the coal feeding pipe 1 is in a position higher than the reference position by the distance L' within the aforementioned range satisfying 0.15≤L'/L≤0.5 (where L'>L1).

Figure 7:
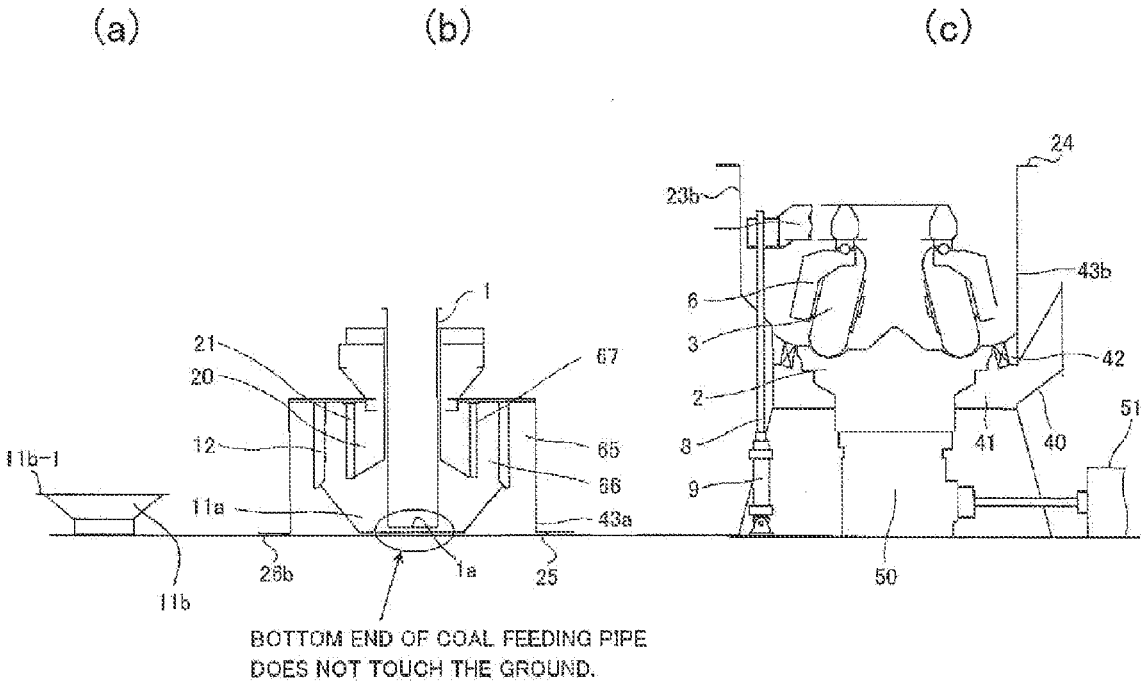
FIGS. 7A-7C Views showing a state in which the vertical-type mill shown in FIG. 1 has been disassembled for maintenance.

For maintenance of the vertical-type mill configured thus, the lower hopper 11*b* is first removed and put in a workplace as shown in FIG. 7(*a*). Next, bolts fastening the upper housing 43*a* and the lower housing 43*b* to each other are removed, and the upper housing 43*a* is slid horizontally as it is. On this occasion, the upper hopper 11*a* and the bottom end 1*a* of the coal feeding pipe 1 do not protrude from the flange portion 25 of the upper housing 43*a* (see FIG. 5). Accordingly, even when the upper housing 43*a* is slid horizontally, there is no fear that the upper hopper 11*a* or the bottom end 1*a* of the coal feeding pipe 1 may collide with the lower housing 43*b*. In addition, since the upper hopper 11*a* and the bottom end 1*a* of the coal feeding pipe 1 are received in the upper housing 43*a*, the upper housing 43*a* can be put in the workplace as it is (FIG. 7(*b*)).

Here, the upper covers 26*a*, 26*b* and 26*c* are provided in the upper housing 43*a*. Accordingly, even when the upper housing 43*a* might lose its balance to overturn, the upper covers 26*a*, 26*b* and 26*c* serve as overturn preventing stoppers. Thus, maintenance work can be performed safely even when the upper housing 43*a* is put in the workplace as it is.

As shown in FIG. 7(*c*), the top of the lower housing 43*b* is opened when the upper housing 43*a* is removed. Thus, maintenance or the like can be performed on the milling roller 3 or the milling table 2.

As described above, in the vertical-type mill according to the aforementioned embodiment, the coal feeding pipe 1 is attached to satisfy "0.15≤L'/L≤0.5". Accordingly, it is possible to prevent abrasion of the hopper 11. At the same time, it is possible to prevent the coarse particles from being deposited in the hopper 11. Further, when the coal feeding pipe 1 is attached to satisfy "0.15≤L'/L≤0.35", it is possible to prevent abrasion of the hopper 11 more greatly.

In addition, in the vertical-type mill according to the embodiment, the upper hopper 11*a* and the bottom end 1*a* of the coal feeding pipe 1 are received inside the upper housing 43*a*. Accordingly, even when the upper housing 43*a* is put in the workplace directly, there is no fear that the upper hopper 11*a* and the bottom end 1*a* of the coal feeding pipe 1 may be damaged due to their contact with the ground. In addition, the upper housing 43*a* can be slid horizontally and separated from the lower housing 43*b*. Accordingly, the step of lifting up the upper housing 43*a* can be omitted to thereby lead to improvement of working efficiency.

In addition, the upper covers 26*a*, 26*b* and 26*c* of the upper housing 43*a* serve as overturn preventing stoppers. Accordingly, there is another advantage that safety of the work can be secured.

Figure 8:
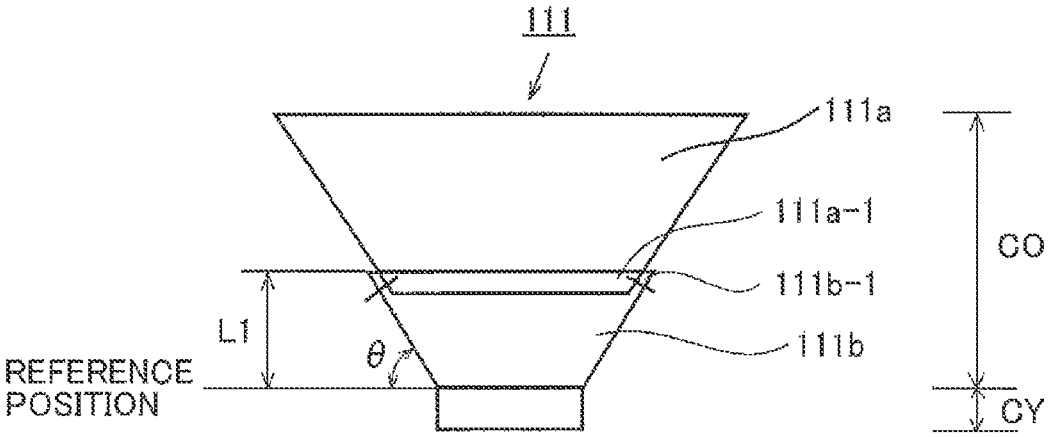
FIG. 8 A view showing the structure of a hopper according to Modification 1.

Next, Modification 1 of the hopper 11 will be described. As shown in FIG. 8, a hopper 111 according to Modification 1 is a funnel-like structure having a hollow inverted conical part CO whose diameter is reduced as it goes from a top end thereof toward a bottom end thereof, and a cylindrical part CY which extends downward from the bottom end of the inverted conical part. Incidentally, the inclination angle θ of the inverted conical part CO of the hopper 111 is 50 degrees.

Further, the hopper 111 is divided into two at a position of height L1 from a reference position when the boundary line between the inverted conical part CO and the cylindrical part CY is set as the reference position. That is, the hopper 111 includes two parts, that is, an upper hopper 111*a* and a lower hopper 111*b*. When a bottom end portion 111*a*-1 of the upper hopper 111*a* is inserted from a top end portion 111*b*-1 of the lower hopper 111*b*, the upper hopper 111*a* is fixed in a predetermined position. The overlapping portion is fixed by bolts and nuts so that the upper hopper 111*a* and the lower hopper 111*b* can be integrated. Incidentally, it is a matter of course that the portion where the upper hopper 111*a* and the lower hopper 111*b* are connected to each other is formed into a smooth surface to prevent coarse particles from being deposited thereon. Even when the hopper 111 according to this modification is used, the same effect as described above can be obtained.

Figure 9:
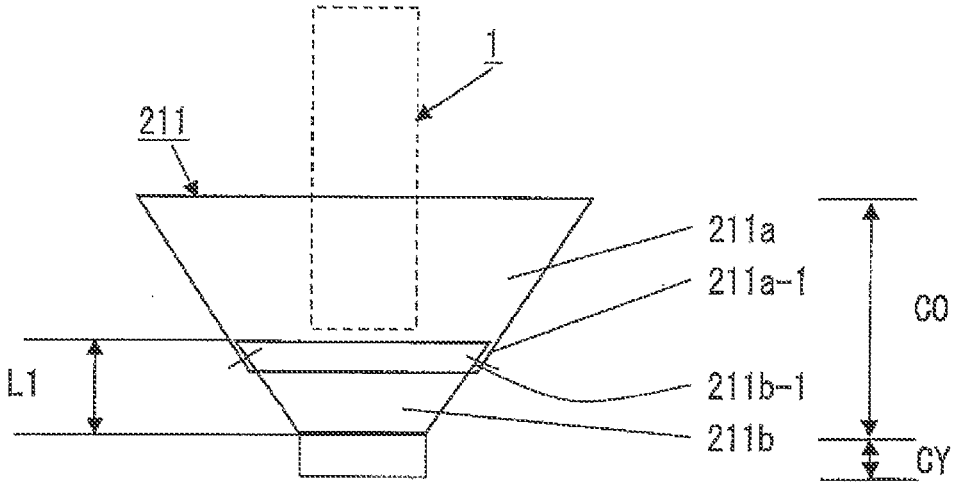
FIG. 9 A view showing the structure of a hopper according to Modification 2.

Next, Modification 2 of the hopper 11 will be described. As shown in FIG. 9, a hopper 211 according to Modification 2 is a funnel-like structure having a hollow inverted conical part CO whose diameter is reduced as it goes from a top end thereof toward a bottom end thereof, and a cylindrical part CY which extends downward from the bottom end of the inverted conical part. Incidentally, the inclination angle θ of the inverted conical part CO of the hopper 211 is 50 degrees.

Further, the hopper 211 is divided into two at a position of height L1 from a reference position when the boundary line between the inverted conical part CO and the cylindrical part CY is set as the reference position. That is, the hopper 211 includes two parts, that is, an upper hopper 211*a* and a lower hopper 211*b*. When the lower hopper 211*b* is inserted inside the upper hopper 211*a* from above, the lower hopper 211*b* is fixed in a predetermined position. The overlapping portion is fixed by bolts and nuts so that the upper hopper 211*a* and the lower hopper 211*b* can be integrated. Incidentally, it is a matter of course that the portion where the upper hopper 211*a* and the lower hopper 211*b* are connected to each other is formed into a smooth surface to prevent coarse particles from being deposited thereon. Even when the hopper 211 according to this modification is used, the same effect as described above can be obtained.

Figure 10:
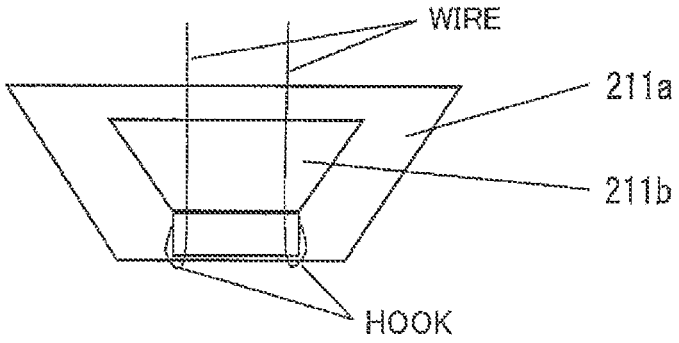
FIG. 10 A view showing a state in which the hopper according to Modification 2 has been divided into an upper hopper and a lower hopper.
Figure 11:
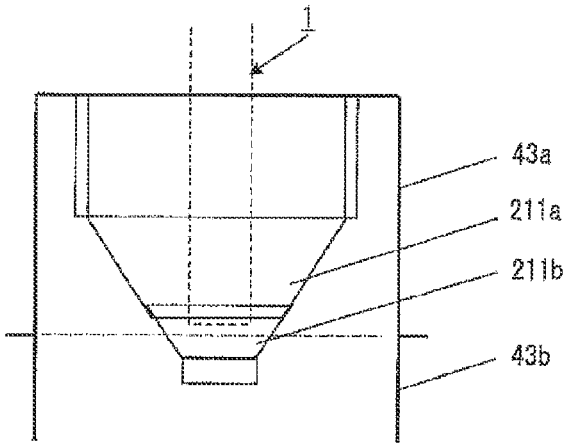
FIGS. 11A-11C Views showing a state in which a vertical-type mill using Modification 2 has been disassembled for maintenance.
Figure 11:
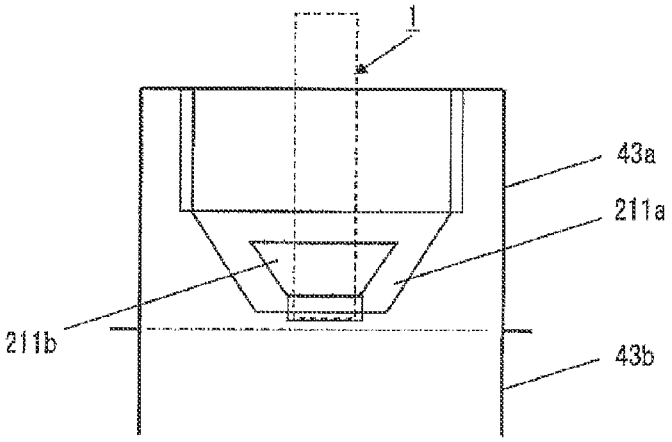
Figure 11:
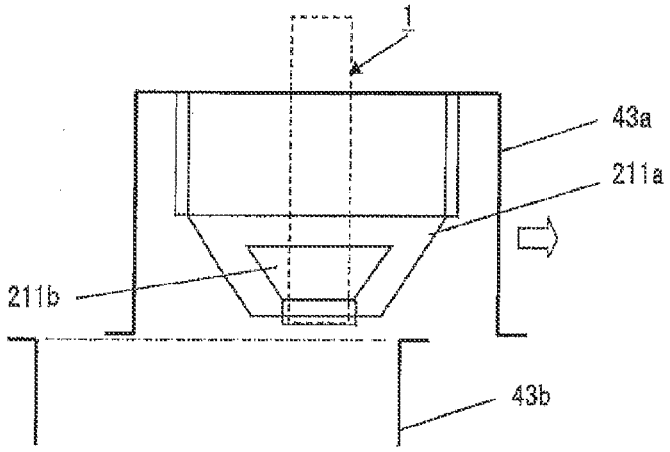

When the hopper 211 is used, maintenance may be performed as follows. That is, the bolts and the nuts for the upper hopper 211*a* and the lower hopper 211*b* are removed during maintenance. Since the cylindrical portion CY of the lower hopper 211*b* is larger than the outer diameter of the coal feeding pipe 1, the bottom end of the cylindrical part CY of the lower hopper 211*b* can be suspended inside the hopper 211*a* by means of hooks (see FIG. 10). In this state, as shown in FIG. 11, the upper housing 43*a* can be separated from the lower housing 43*b* and moved horizontally in the state where the hopper 211 is received inside the upper housing 43*a*. Thus, working efficiency is improved during the maintenance of the vertical-type mill.

In the aforementioned embodiment, the relation between the distance L' from the reference position to the bottom end 1*a* of the coal feeding pipe 1 and the distance L1 from the reference position to the division position between the upper housing 43*a* and the lower housing 43*b* is set to be L'>L1. However, the relation may be set to be L'=L1. In addition, although the milling roller 3 is used in the aforementioned embodiment, it is a matter of course that a milling ball may be used in place of the milling roller 3.

REFERENCE SIGNS LIST

1 . . . coal feeding pipe (raw material feeding pipe), 2 . . . milling table, 3 . . . milling roller, 5 . . . pressure frame, 8 . . . pressure rod, 9 . . . pressure device, 11 . . . hopper, 11*a* . . . upper hopper, 11*b* . . . lower hopper, 12 . . . classifier, 20 . . . classifier, 23*a*,23*b*,23*c* . . . rod box, 23*a*-1,23*b*-1,23*c*-1 . . . opening of rod box, 26*a*,26*b*,26*c* . . . upper cover (cover member), 43 . . . housing, 43*a* . . . upper housing, 43*b* . . . lower housing, 60 . . . coal (material to be milled), 111 . . . hopper, 111*a* . . . upper hopper, 111*b* . . . lower hopper, 211 . . . hopper, 211*a* . . . upper hopper, 211*b* . . . lower hopper, B . . . milling portion (milling mechanism), C . . . classification portion (classification mechanism), E . . . pressure portion (pressure mechanism), CO . . . inverted conical part, CY . . . cylindrical part

The invention claimed is:

1. A vertical-type mill comprising:

a milling mechanism which has a milling roller or a milling ball, and a milling table rotatably disposed in a position facing the milling roller or the milling ball, and which mills a material to be milled and obtains solid particles by meshing of the milling table with the milling roller or the milling ball;

a classification mechanism which is disposed above the milling mechanism and which has a classifier for classifying the milled solid particles, and a hopper for collecting coarse particles classified by the classifier and dropped downward, and guiding the coarse particles to the milling mechanism;

a raw material feeding pipe through which the material to be milled can be inputted onto the milling table and which is provided so that a bottom end of the raw material feeding pipe can be located inside the hopper; and a housing which receives the milling mechanism and the classification mechanism; wherein:

the hopper is a funnel-like structure having a hollow inverted conical part whose diameter is reduced as it goes from a top end thereof toward a bottom end thereof, and a cylindrical part which extends downward from the bottom end of the inverted conical part; and the raw material feeding pipe is provided in the hopper to satisfy the relation $0.15 \leq L'/L \leq 0.5$, where, using a boundary line between the inverted conical part and the cylindrical part of the hopper as a reference position, L is a distance from the reference position to the top end of the hopper, and L' is a distance from the reference position to the bottom end of the raw material feeding pipe.

2. A vertical-type mill according to claim 1, wherein:

the relation $L'/L \leq 1.35$ is further satisfied.

3. A vertical-type mill according to claim 1, wherein:

the housing is formed so that the housing can be divided into an upper housing receiving the classification mechanism and a lower housing receiving the milling mechanism;

the hopper is formed so that the hopper can be divided into an upper hopper and a lower hopper;

the bottom end of the raw material feeding pipe is in a position as high as or higher than a boundary line between the upper hopper and the lower hopper; and a boundary line between the upper housing and the lower housing is in a position as high as or lower than the boundary line between the upper hopper and the lower hopper.

4. A vertical-type mill according to claim 3, wherein:

the boundary line between the upper hopper and the lower hopper is in a position higher than the reference position.

5. A vertical-type mill according to claim 3, wherein:

the boundary line between the upper housing and the lower housing is in a position higher than the reference position.

6. A vertical-type mill according to claim 3, further comprising:

a pressure mechanism which has a pressure device, a pressure frame which transmits pressure to be applied to the milling table to the milling roller or the milling ball, and a pressure rod which couples the pressure device with the pressure frame; wherein:

a rod box through which the pressure rod can be inserted is provided in an outer peripheral surface of the lower housing; and a cover member which closes an opening formed in a top portion of the rod box is provided in a bottom end portion of the upper housing.

* * * * *